US005645244A

United States Patent [19]

Moody

[11] Patent Number: 5,645,244

[45] Date of Patent: Jul. 8, 1997

[54] DISPENSER APPARATUS FOR DISPENSING PAPER SHEET MATERIAL

[75] Inventor: John R. Moody, Antioch, Calif.

[73] Assignee: James River Corporation of Virginia, Richmond, Va.

[21] Appl. No.: 611,985

[22] Filed: Mar. 5, 1996

[51] Int. Cl.[6] ..... B65H 23/06; B65H 19/00

[52] U.S. Cl. ..... 242/422.5; 242/560; 242/560.3

[58] Field of Search ..... 242/422.5, 560.3, 242/560; 312/34.22

[56] References Cited

U.S. PATENT DOCUMENTS

| | | | |
|---|---|---|---|
| 1,690,858 | 11/1928 | Fleischmann | 242/422.5 X |
| 2,240,629 | 5/1941 | Smith | 242/597 |
| 2,307,994 | 1/1943 | Clemens | 242/560.3 X |
| 2,510,537 | 6/1950 | Agamaite, Jr. | 242/560 |
| 2,908,451 | 10/1959 | Tucker et al. | 242/560 |
| 3,291,411 | 12/1966 | Krueger et al. | 242/560 |
| 3,294,329 | 12/1966 | Tucker et al. | 242/560.2 |
| 3,650,487 | 3/1972 | Bahnsen | 242/560.3 |
| 3,677,485 | 7/1972 | Berg | 242/560.2 |
| 4,422,585 | 12/1983 | Schultz et al. | 242/560 |
| 4,832,271 | 5/1989 | Geleziunas | 242/422.5 |
| 4,872,601 | 10/1989 | Sigmund | 242/560 |
| 5,265,816 | 11/1993 | Collins | 242/560 |

*Primary Examiner*—John Q. Nguyen
*Attorney, Agent, or Firm*—Thomas R. Lampe

[57] ABSTRACT

Dispenser apparatus for dispensing paper sheet material from one or more paper rolls includes a housing having a bottom opening communicating with the interior of the housing. A paper roll support is located at the bottom opening partially closing the bottom opening. The paper roll support forms a dispensing opening into which the paper roll projects to provide ready access to the paper roll. The paper roll support includes a downwardly curved roll engagement surface which forms a nip with the paper roll during dispensing.

7 Claims, 6 Drawing Sheets

DISPENSER APPARATUS FOR DISPENSING PAPER SHEET MATERIAL

TECHNICAL FIELD

This invention relates to dispenser apparatus for dispensing paper sheet material from rolls thereof. The invention is particularly applicable to the dispensing of toilet tissue from large rolls thereof.

BACKGROUND ART

The preferred embodiment of the invention disclosed herein is for the purpose of dispensing toilet tissue from two large rolls thereof, such dispensing being carried out alternately with respect to the rolls.

It is well known in the prior art to employ dispensers holding two or more rolls of toilet tissue or similar sheet material which maintains at least one of the rolls as a reserve roll while the sheet material is being dispensed from the other roll. Such devices are usually, but not exclusively, employed in institutional environments such as public restrooms.

The following United States patents are believed to be representative of the current state of the prior art in this field: U.S. Pat. No. 4,872,601, issued Oct. 10, 1989, U.S. Pat. No. 5,265,816, issued Nov. 30, 1993, U.S. Pat. No. 3,291,411, issued Dec. 13, 1966, U.S. Pat. No. 2,510,537, issued Jun. 6, 1950, U.S. Pat. No. 4,422,585, issued Dec. 27, 1983, U.S. Pat. No. 3,677,485, issued Jul. 18, 1972, U.S. Pat. No. 3,294,329, issued Dec. 27, 1966, and U.S. Pat. No. 2,240, 629, issued May 6, 1941.

Most of the above-identified patents disclose dispensers for dispensing toilet tissue or other paper sheet material from two rolls and the present invention is utilized for such purpose also. However, the present invention addresses a problem inherent in conventional prior art dispensers; more particularly, the dispenser apparatus disclosed and claimed herein allows easy access to the roll from which paper sheet material is being dispensed throughout the entire dispensing operation. The roll location is always maintained at the lower portion of the dispenser. Conventional prior art dispensers typically require the user to reach up into the interior of the dispenser to obtain manual access to tissue or other paper sheet material being dispensed as the roll decreases in diameter.

The present invention is also characterized by its relative simplicity and low expense, as well as by its ease of use as compared to many prior art constructions.

DISCLOSURE OF INVENTION

The present invention relates to dispenser apparatus for dispensing paper sheet material from at least one paper roll. The dispenser apparatus includes a housing defining a housing interior and a bottom opening communicating with the housing interior.

The apparatus also includes paper roll positioning means positioning a paper roll within the housing interior, the paper roll having a paper sheet material lead end and rotatably mounted relative to the paper roll positioning means.

A paper roll support is connected to the housing and located at the bottom opening. The paper roll support partially closes the bottom opening and forms a dispensing opening comprising a portion of the bottom opening.

The paper roll support has a roll engagement surface engaged by and at least partially supporting the paper roll rotatably mounted relative to the paper roll positioning means. The paper roll positioning means continuously positions the paper roll on the roll engagement surface to form a nip between the paper roll and the roll support engagement surface while the paper roll rotates during dispensing of paper sheet material therefrom through the dispensing opening.

The roll engagement surface extends downwardly and partially defines the dispensing opening. The paper roll projects alongside and downwardly from the roll engagement surface and into the dispensing opening with the paper sheet material lead end extending from the remainder of the paper roll and from the nip downwardly through the dispensing opening.

In the embodiment disclosed herein the paper roll positioning means comprises two pivot arms independently pivotally connected to the housing, each pivot arm including a spindle rotatably retaining a paper roll.

In the disclosed embodiment of the invention paper roll support is slidably mounted relative to the housing and moveable relative to the housing between a first position wherein a first portion of the bottom opening forms the dispensing opening and a second position wherein a second portion of the bottom opening forms a dispensing opening. The paper roll projecting alongside and downwardly from the roll engagement surface biases the paper roll support to either the first position or the second position.

Other features, advantages, and objects of the present invention will become apparent with reference to the following description and accompanying drawings.

BEST MODE FOR CARRYING OUT THE INVENTION

Figure 1:
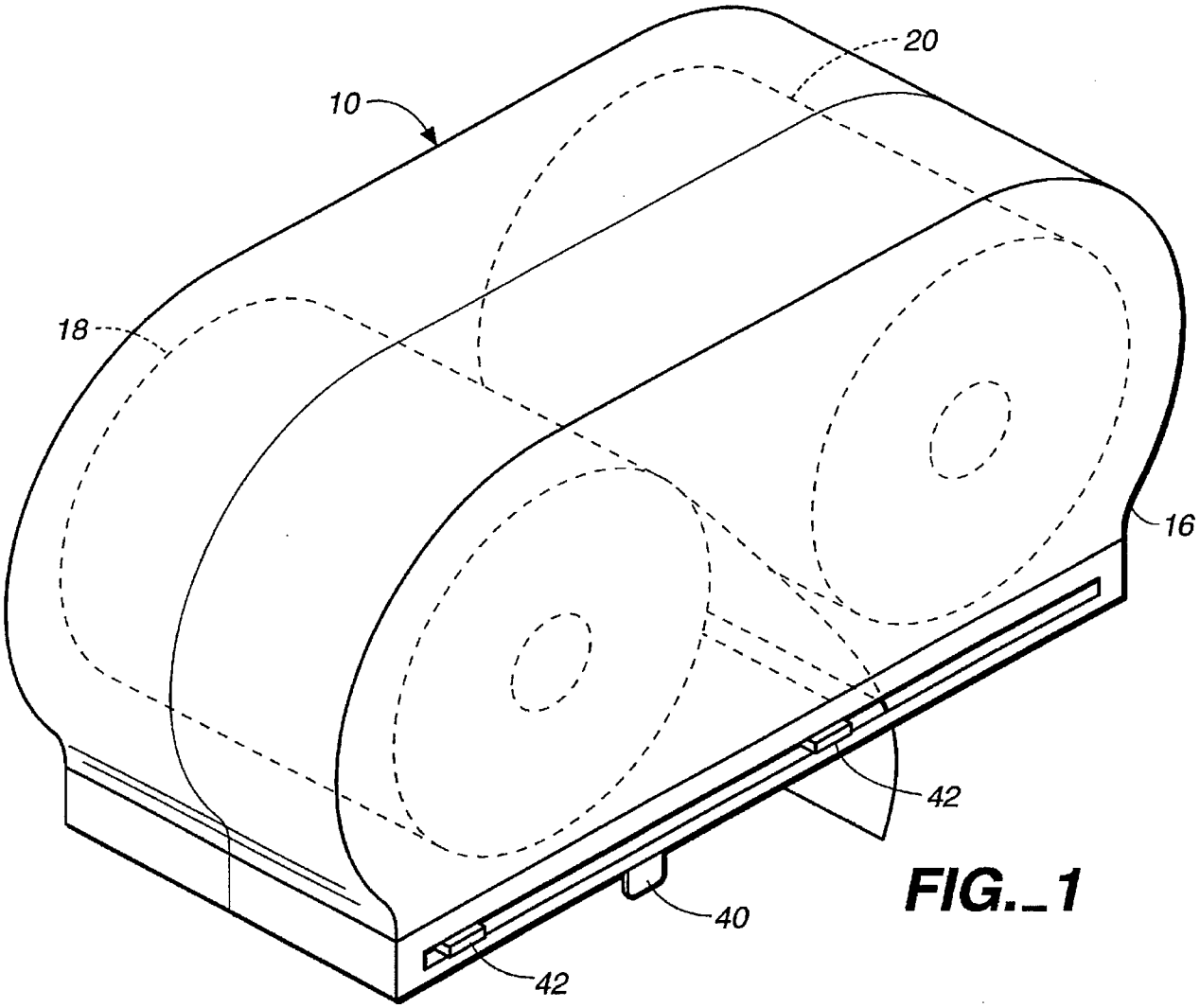
FIG. 1 is a perspective view illustrating dispenser apparatus constructed in accordance with the teachings of the present invention having two large rolls of toilet tissue located within the interior thereof.
Figure 2:
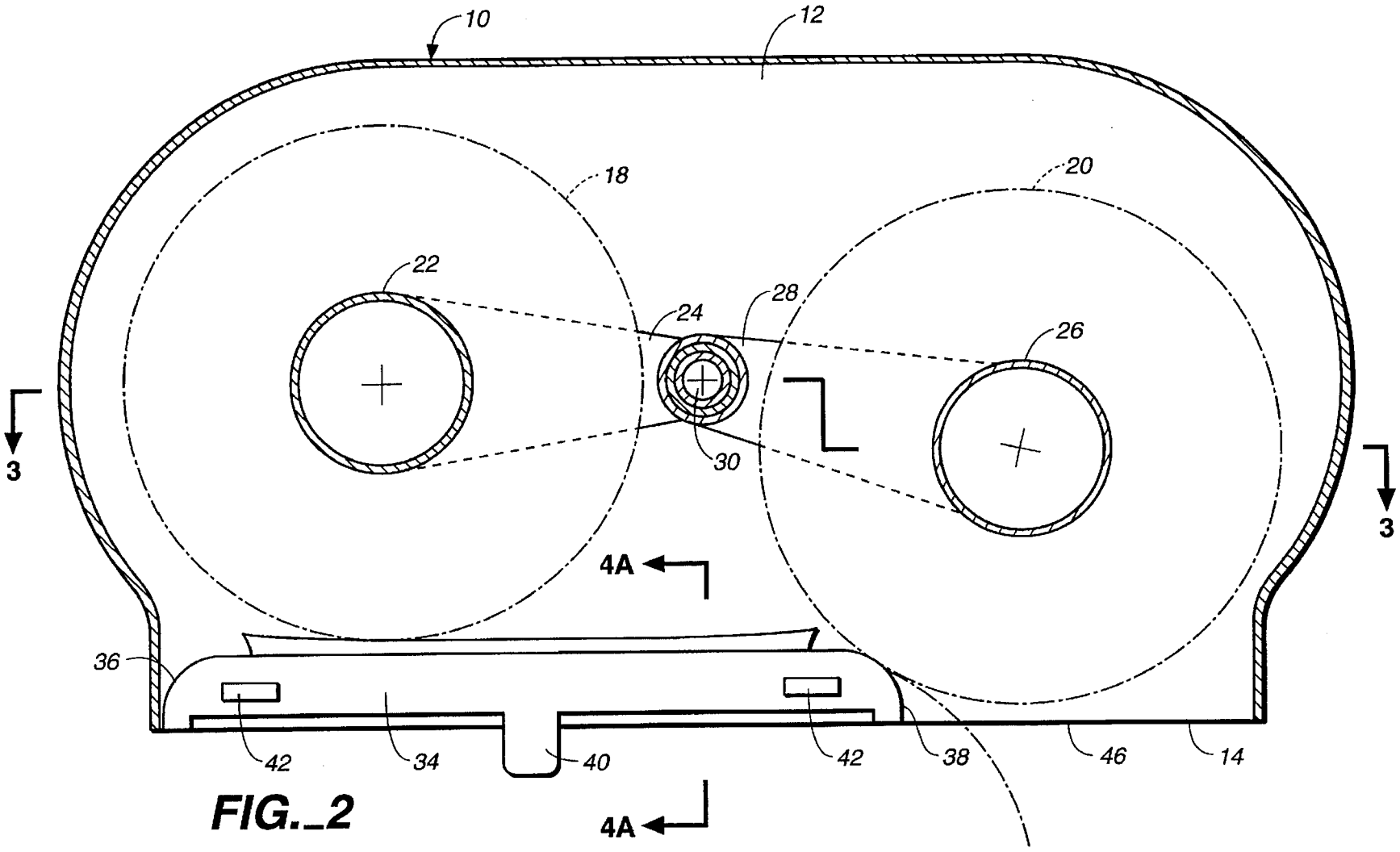
FIG. 2 is a somewhat diagrammatic, cross-sectional, front elevation view of the housing and related structure of the dispenser apparatus, the rolls of toilet tissue held thereby illustrated by phantom lines.
Figure 3:
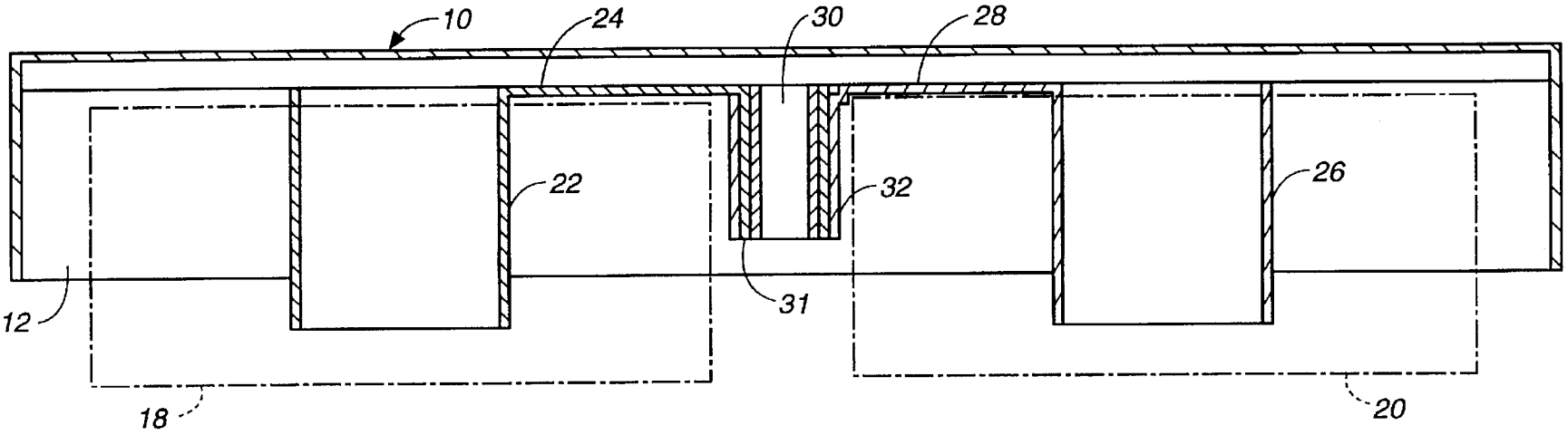
FIG. 3 is a cross-sectional view taken along the line 3—3 in FIG. 2.
Figure 6:
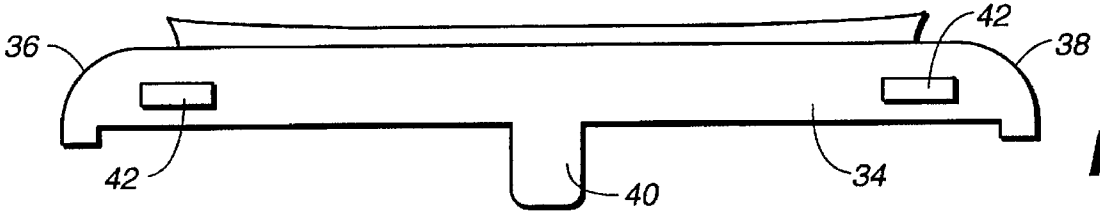
FIG. 6 is an enlarged, front elevation view of the paper roll support employed in the dispenser apparatus.

Referring now to the drawings, dispenser apparatus constructed in accordance with the teachings of the present invention includes a housing 10 defining a housing interior 12 and a bottom opening 14 communicating with the housing interior. In the arrangement illustrated, the bottom opening 14 extends virtually across the full width of the housing.

Figure 4:
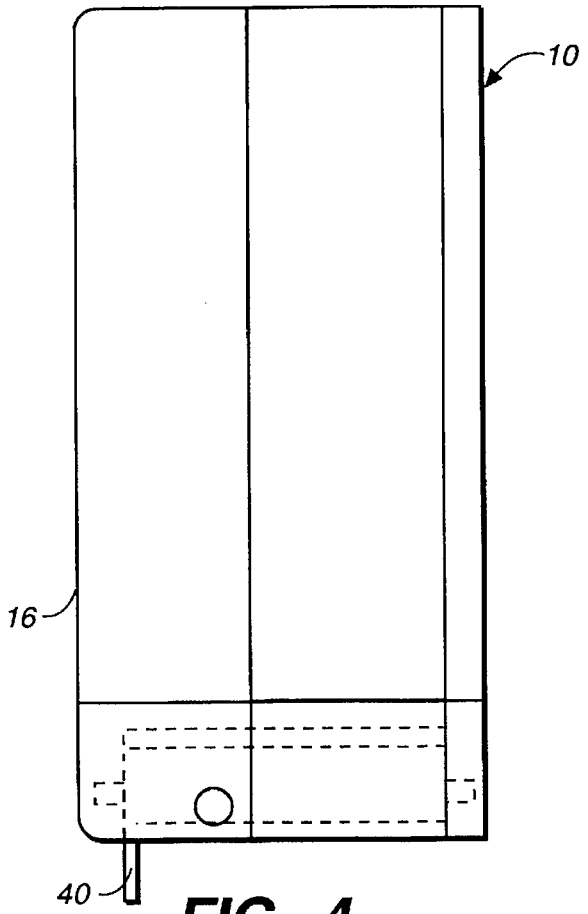
FIG. 4 is a side elevational view of the dispenser apparatus illustrating the housing cover in closed position.
Figure 4A:
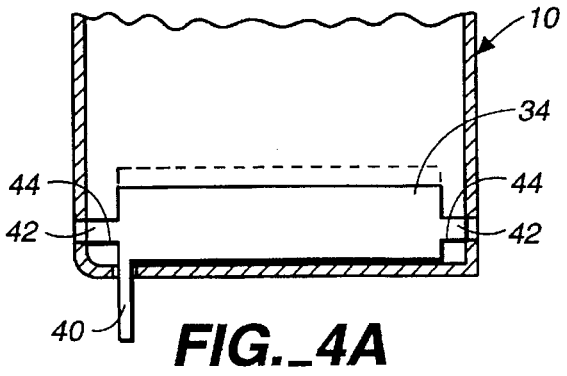
FIG. 4A is a cross-sectional view taken along the line 4A—4A in FIG. 2.
Figure 5:
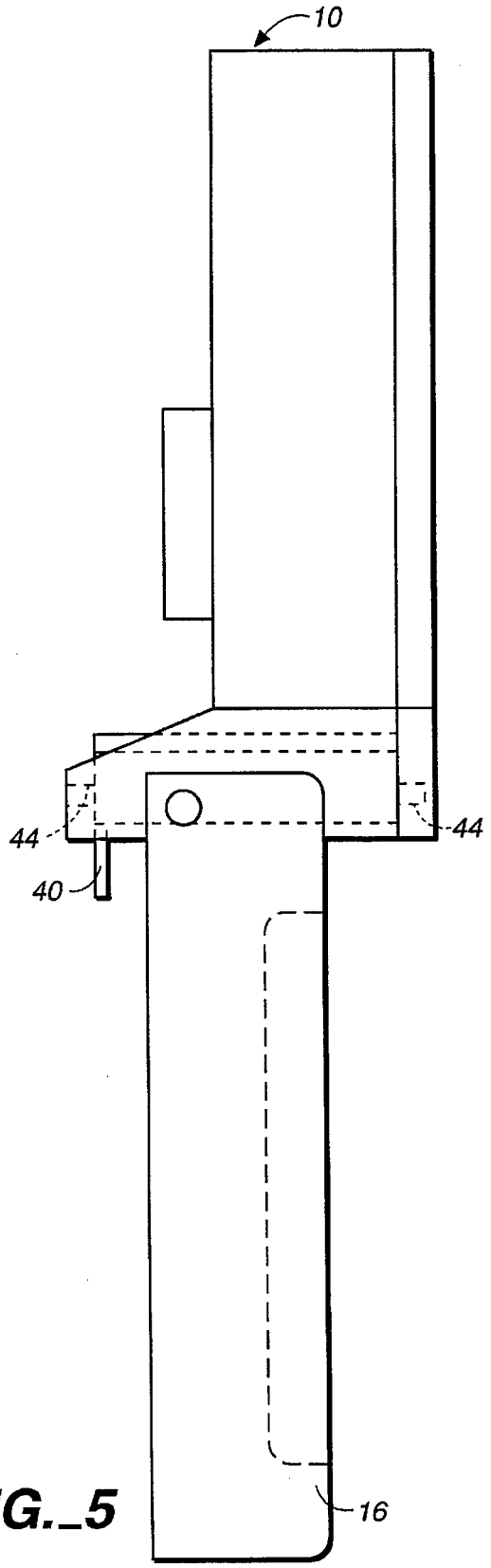
FIG. 5 is a view similar to FIG. 4 but illustrating the housing cover in open position.

A cover 16 is hingedly connected to the remainder of the housing and is pivotedly moveable between the closed position shown in FIG. 4 to the open position shown in FIG. 5, the cover when in the latter position exposing the interior of the housing.

Two large rolls of toilet tissue 18 and 20 are normally located within the housing interior. Roll 18 is rotatably mounted on a spindle 22 which projects from and is connected to a pivot arm 24 rotatably connected at the other end thereof to housing 10 at the center of the housing. Likewise, roll 20 is rotatably mounted on a spindle 26 connected to a pivot arm 28 also pivotally connected to housing 10 at the center of the housing. In the arrangement illustrated, the arms 24, 28 are freely rotatably disposed about a mounting shaft 30 projecting inwardly from the housing back wall. A sleeve 31 at the end of arm 24 is rotatably mounted directly on shaft 30 and a sleeve 32 on arm 28 is rotatably mounted over sleeve 31. The arms and spindles projecting therefrom operate as paper roll positioning means for positioning the paper rolls within the housing interior.

Slidably mounted relative to the housing at the bottom thereof is a paper roll support 34. Paper roll support 34 is of double-ended configuration and has two roll engagement surfaces 36, 38, one at each end. The roll engagement surfaces are curved and extend downwardly from the top of the paper roll support.

Figure 8:
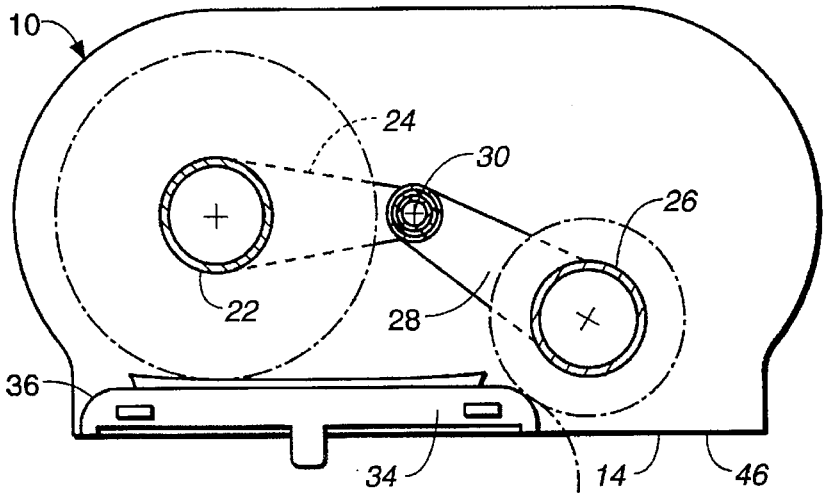
Figure 9:
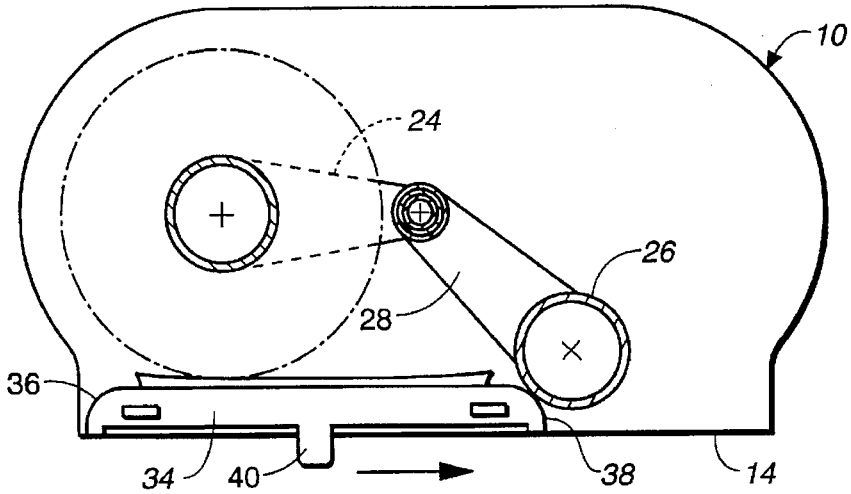
Figure 10:
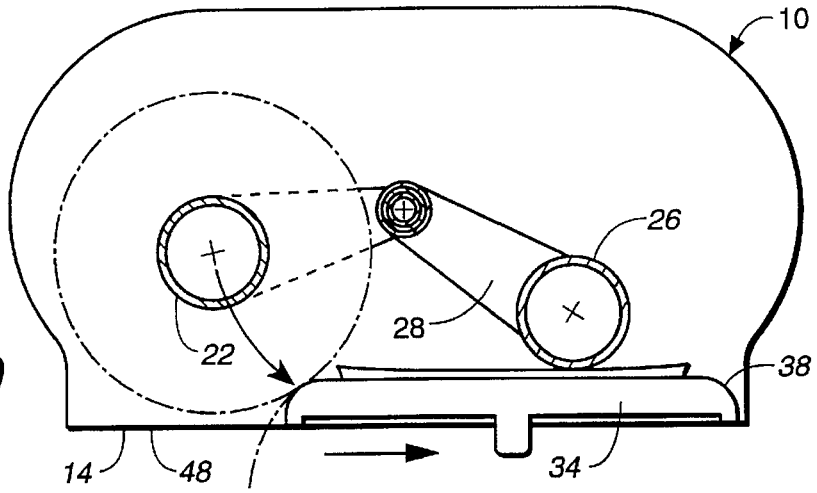
Figure 11:
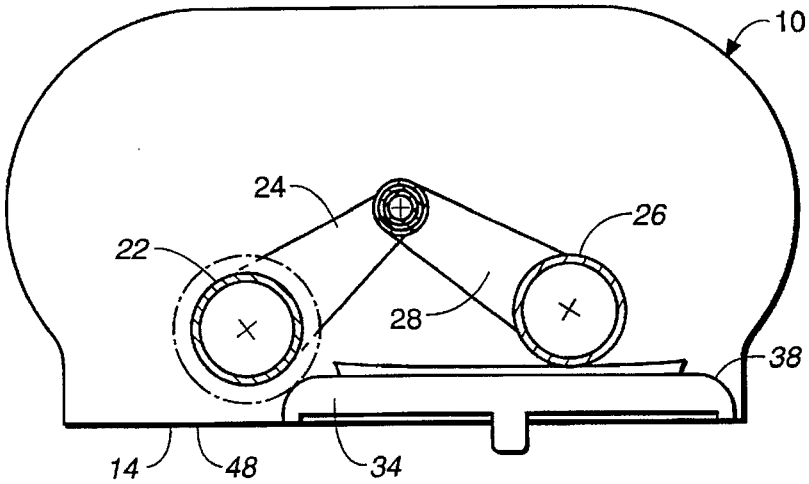

The paper roll support 34 is slideably moveable relative to the housing from a first position shown in FIG. 2 and FIGS. 7–9 to a second position shown in FIGS. 10 and 11. Movement may be manually effected by means of a downwardly projecting handle 40 affixed to the paper roll support. In the arrangement illustrated, tabs 42 project outwardly from the sides of the paper roll support and are positionable in slots 44 in the housing to maintain the paper roll support 34 connected to the housing.

When paper roll support 34 is at its first position or location (the location shown in FIG. 2 and FIGS. 7–9) it partially closes bottom opening 14 and forms a dispensing opening 46 comprising a portion of the bottom opening 14. Roll 18 is supported directly on the top of the paper roll support 34 while roll 20 is continuously positioned under the influence of gravity and by its associated support arm and spindle on roll engagement surface 38 to form a nip between the paper roll 20 and roll engagement surface 38 while the paper roll rotates during dispensing of the paper sheet material therefrom through the dispensing opening.

Paper roll 20 projects alongside and downwardly from the roll engagement surface 38 and into the dispensing opening with the paper sheet material lead end extending from the remainder of the paper roll. A consumer thus has ready access to the toilet tissue roll located at the dispensing opening throughout the entire dispensing operation with respect to that roll. The dispenser apparatus always operates to maintain the tissue roll at the lower or bottom area of the dispenser apparatus as compared to conventional prior art dispensers which often require the user to reach up into the dispenser to dispense tissue as the rolls decrease in diameter.

Roll 20 also performs another function. The roll continuously urges the paper roll support 34 toward its first position or location.

Figure 7:
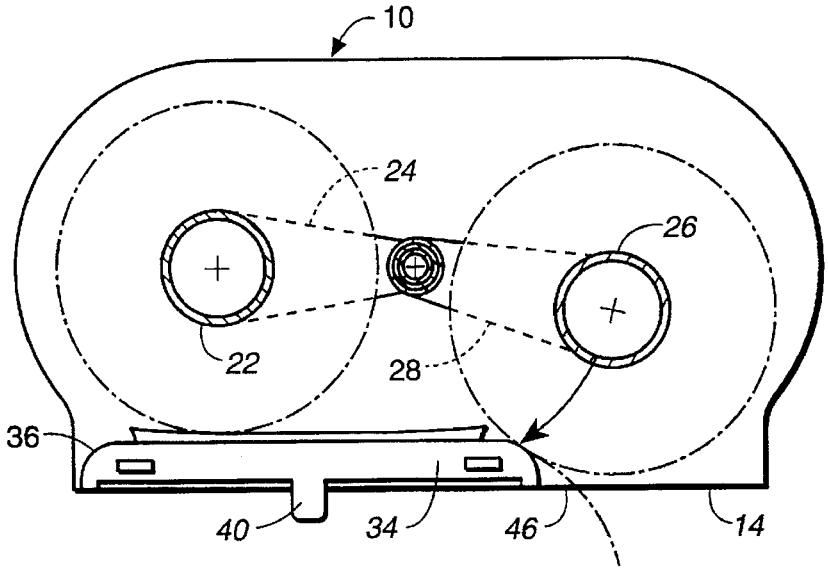
FIGS. 7 through 11 are diagrammatic illustrations illustrating structural components of the dispenser apparatus in the relative positions assumed thereby during sequential stages of operation of the dispenser apparatus, the toilet tissue rolls within the interior being illustrated by phantom lines

As illustrated in FIGS. 7 through 9, the roll 20 will maintain engagement with the paper roll support until paper is depleted. Now the user manually slides the paper roll support to its second position or location in the direction of the arrow shown in FIGS. 9 and 10.

FIG. 10 shows the paper roll support 34 at its second location and roll 18 is now located in the dispensing position and bears against roll engagement surface 36. Roll 18 is located over dispensing opening 48 which was created when the paper roll support 34 was moved to the second position shown in FIGS. 10 and 11. The roll 18 will exert a continuous endwise force on the paper roll support 34 urging it to the right as viewed in FIGS. 10 and 11 to maintain the paper roll support in its desired position until depletion of roll 18.

We claim:

1. Dispenser apparatus for dispensing paper sheet material from at least one paper roll having a central opening, said dispenser apparatus comprising, in combination:

a housing defining a housing interior and a bottom opening communicating with said housing interior;

paper roll positioning means engaging a paper roll having a lead end within said housing interior for positioning said paper roll within said housing interior with said paper roll rotatably mounted on said paper roll positioning means; and a paper roll support slidably connected to said housing and located at said bottom opening and partially closing said bottom opening, and said paper roll support and said housing forming a dispensing opening comprising a portion of said bottom opening, said paper roll support having a roll engagement surface located adjacent to said paper roll engaged by and at least partially supporting said paper roll, and said paper roll positioning means being movable relative to said paper roll support and maintaining said paper roll in engagement with said roll engagement surface to form a nip between said paper roll and said roll engagement surface while said paper roll rotates during dispensing of paper sheet material therefrom through said dispensing opening, said roll engagement surface extending downwardly and partially defining said dispensing opening, and said paper roll projecting alongside and downwardly from said roll engagement surface and into said dispensing opening with the paper sheet material lead end of said paper roll extending from the remainder of said paper roll and from said nip downwardly through said dispensing opening, said paper roll support being slidably movable relative to said housing between a first position wherein a first portion of said bottom opening is not closed by said paper roll support and comprises the dispensing opening and a second position wherein a second portion of said bottom opening is not closed by said paper roll support and comprises the dispensing opening, the weight of said paper roll projecting alongside and downwardly from said roll engagement surface exerting a biasing force on said paper roll support biasing said paper roll support to either said first position or said second position.

2. The dispenser apparatus according to claim 1 wherein said paper roll positioning means comprises at least one pivot arm pivotally connected to said housing and including a spindle rotatably retaining a paper roll.

3. The dispenser apparatus according to claim 2 wherein said paper roll positioning means comprises two pivot arms independently pivotally connected to said housing, each pivot arm including a spindle rotatably retaining a paper roll.

4. The dispenser apparatus according to claim 1 wherein said roll engagement surface curves downwardly at the location of the nip.

5. The dispenser apparatus according to claim 1 wherein said paper roll positioning means engages and positions two paper rolls within said housing interior at two different locations, one of said paper rolls being located by said positioning means above the first portion of said bottom opening and the other of said paper rolls being located by said positioning means above the second portion of said bottom opening.

6. The dispenser apparatus according to claim 5 wherein said slidably mounted paper roll support is double-ended, each of said ends having a roll engagement surface for engagement by one of said paper rolls.

7. The dispenser apparatus according to claim 6 wherein said paper roll positioning means comprises two pivot arms independently pivotally connected to said housing, each pivot arm including a spindle rotatably retaining one of said paper rolls.

* * * * *